US006102508A

United States Patent [19]

Cowger

[11] Patent Number: 6,102,508

[45] Date of Patent: Aug. 15, 2000

[54] METHOD AND APPARATUS FOR SELECTING PRINTER CONSUMABLES

[75] Inventor: Bruce Cowger, Corvallis, Oreg.

[73] Assignee: Hewlett-Packard Company, Palo Alto, Calif.

[21] Appl. No.: 08/721,815

[22] Filed: Sep. 27, 1996

[51] Int. Cl.[7] ..... B41J 2/195

[52] U.S. Cl. ..... 347/7; 347/19

[58] Field of Search ..... 347/6, 7, 19, 85–87; 399/27; 400/249, 703, 74; 116/109, 227

[56] References Cited

U.S. PATENT DOCUMENTS

| | | | |
|---|---|---|---|
| 4,922,294 | 5/1990 | Nakagami et al. | 399/10 |
| 5,049,898 | 9/1991 | Arthur et al. | 347/19 |
| 5,068,806 | 11/1991 | Gatten | 395/113 |
| 5,365,312 | 11/1994 | Hillmann et al. | 355/206 |
| 5,506,611 | 4/1996 | Ujita et al. | 347/86 |
| 5,682,140 | 10/1997 | Christensen et al. | 340/540 |
| 5,694,156 | 12/1997 | Hoisington et al. | 347/7 |

FOREIGN PATENT DOCUMENTS

| | | | |
|---|---|---|---|
| 0 707 969 | 4/1996 | European Pat. Off. | B41J 2/17 |

*Primary Examiner*—John Barlow
*Assistant Examiner*—Craig A. Hallacher
*Attorney, Agent, or Firm*—Kevin B. Sullivan

[57] ABSTRACT

The present invention is a printing device of the type having a replaceable consumable for forming images on print media. The printing device includes a device for determining a replacement condition for the replaceable consumable. Also included is a storage device containing consumable image information. The printing device forms an image on print media of the replaceable consumable upon the occurrence of the replacement condition.

18 Claims, 3 Drawing Sheets

METHOD AND APPARATUS FOR SELECTING PRINTER CONSUMABLES

BACKGROUND OF THE INVENTION

The present invention relates to printing devices of the type which make use of a consumable for forming images on print media. More specifically, the present invention relates to a method and apparatus for selecting a proper consumable for the printing device.

Printing devices for forming images on print media such as ink jet printers or electrophotographic printers, to name a few, frequently make use of a replaceable consumable. For the case of ink jet printers, the replaceable consumable contains an ink supply. This ink supply may be integral with the printhead in the case of a print cartridge or maybe a separate ink container in the case of an off-axis type ink supply. Electrophotographic printers such as laser printers frequently make use of a replaceable consumable which is in the form of a toner cartridge. When the supply of toner within the toner cartridge is exhausted the toner cartridge is replaced with a new toner cartridge which includes a new supply of toner. It is critical that this replaceable consumable, no matter what the form of the consumable, be replaced with a consumable that is properly selected for the particular printer and properly suited for the particular application. For example, in the case of ink jet printers it is critical that the new ink consumable be compatible with the particular media used, compatible with the remaining ink in the printhead for the case of off-axis type ink supplies and properly suited for the particular application. The particular application can vary from office printing applications to outdoor sign applications which may require light fast and waterfast inks. Finally, it is important that the consumable have the proper color for the particular application.

The problem of selecting a proper consumable is compounded by the fact that the proper consumable must be selected from a number of consumables having similar configurations but the contents of each of the choices are different. For example, there may be more that a dozen different cartridges all of which appear to be suitable for a given ink jet printer. These cartridges each have different ink colors or have different ink formulations and chemistry for particular applications. Therefore, it may be difficult for the user to properly select a particular consumable from this array of choices.

In addition, many manufactures make use of similar color schemes or product configurations to establish a family of products. Establishing a family of products makes it easy to determine the proper product family but may make it difficult to determine the particular product within the product family because of the similarity in color and product configuration.

Another problem that may be encountered when selecting consumables is that many consumables may be offered under more than one brand name. These brand names may be authorized or unauthorized by the manufacture of the printer. To select a proper consumable one must know which brand names one is looking for in addition to identifying the particular consumable from a host of consumables sold under the particular brand name.

Some printing devices make use of keying systems for preventing the insertion of incompatible consumables to prevent damage to the printer or ensure output image quality. However, keying systems are useful for identifying incompatible consumables only after an attempt has been made to insert the consumable into the printing device. By this time, the user has already purchased the consumable and now must return the product. The user then is faced with the problem of again attempting to select the proper consumable.

There is a present need for a technique for assisting the user to ensure that the proper consumable is selected. This technique should be effective and not add significantly to the cost of the printer.

SUMMARY OF THE INVENTION

The present invention is a printing device of the type having a replaceable consumable for forming images on print media. The printing device includes a device for determining a condition for printing the replaceable consumable. Also included is a storage device containing consumable image information. The printing device forms an image on print media of the replaceable consumable upon the occurrence of the condition for printing the replaceable consumable.

In one preferred embodiment the condition for printing the replaceable consumable is when the consumable is nearly empty. In one embodiment the storage device containing the consumable image information is associated with the printing device. Alternatively, the storage device containing the consumable image information is associated with the printing device.

DETAILED DESCRIPTION OF THE PREFERRED EMBODIMENT

Figure 1:
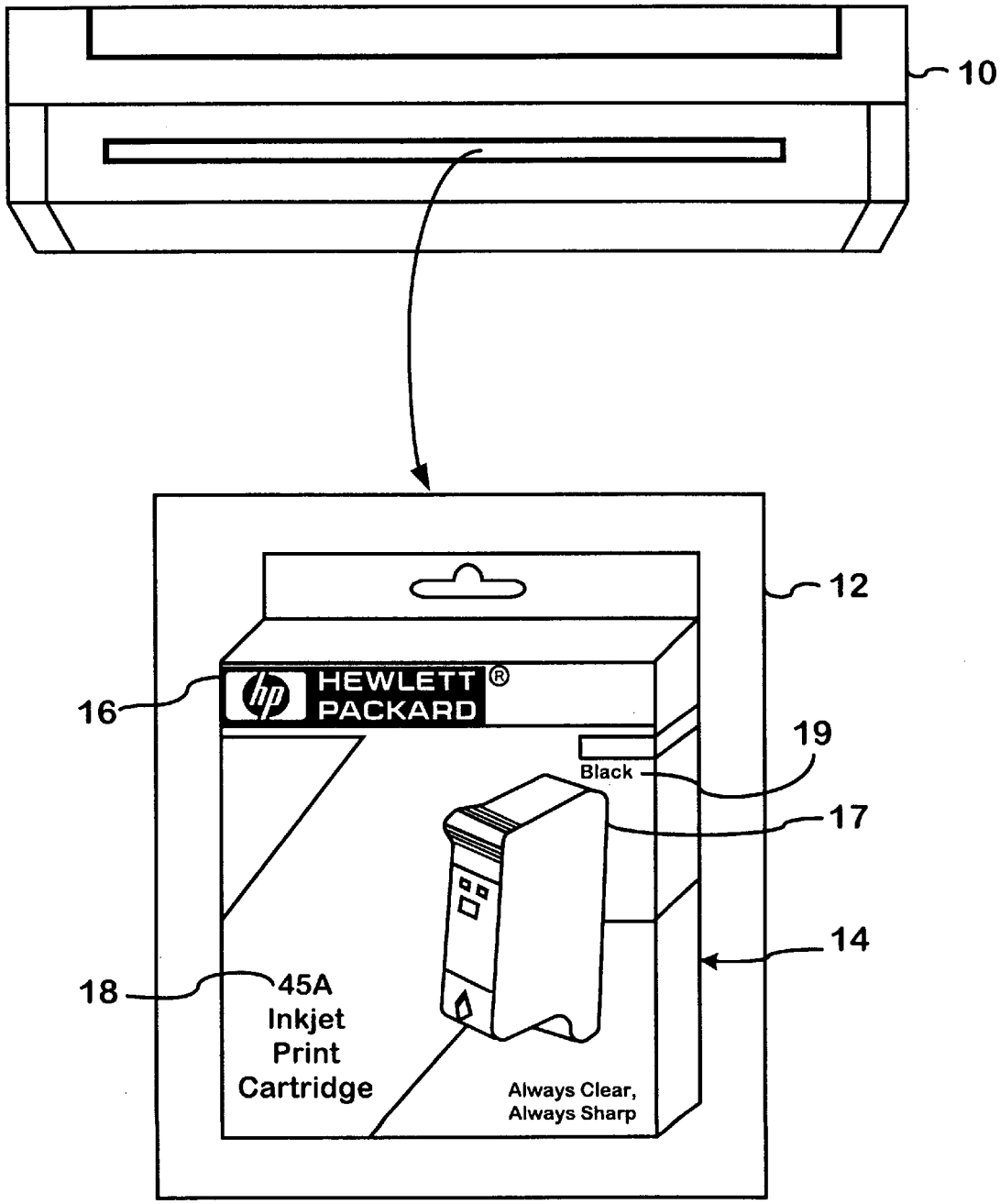
FIG. 1 depicts a printing device of the present invention and an image of the replaceable consumable formed by the printing device for selecting a proper replacement consumable for the printing device.

FIG. 1 depicts a printing device 10 of the present invention of the type having a replaceable consumable for forming images on print media 12. Included in the preferred embodiment of the printing device 10 is a device for determining a condition for printing an image of the replaceable consumable. Upon the occurrence of the condition for printing an image of the replaceable consumable, the printing device 10 forms an image 14 on the print media 12 of the replaceable consumable. The proper consumable can then be selected by using the image 14 of the replaceable consumable to visually identify or match the proper replaceable consumable from a plurality of replaceable consumables.

The image 14 of the replaceable consumable is an image of the consumable as displayed in retail sale displays. This image 14 of the replaceable consumable is therefore an image of the retail packaging, for the case of packaged consumables. For the case where the consumable is not packaged in retail displays the image 14 of the replaceable consumable is an image of the replaceable consumable itself without packaging. In general, the image 14 of the replaceable consumable may include logo's 16 that are present on the package as well as text 18 which is included on the retail packaging for properly selecting the correct consumable. This text 18 may include appropriate part numbers, model numbers, color 19 or any other text or a graphic image 17 which allows one to properly identify the correct consumable. This image 14 on print media 12 becomes a shopping list for one to purchase the proper replaceable consumable at an appropriate retail outlet.

For example, the image 14 of the replaceable consumable shown in FIG. 1 is a representation of the retail packaging for a 45A ink jet print cartridge having black ink for use in a Hewlett Packard Deskjet 850C printer 10. Both the 45A inkjet print cartridge and Deskjet 850C are manufactured by the Hewlett-Packard Company, Palo Alto, Calif. The image 14 of the retail packaging shown in FIG. 1 is not intended to be accurate or complete. For example, the image 14 of the retail packaging shown in FIG. 1 is not a color image nor does this image include all the graphics, among other things, that are used in actual retail packaging for this cartridge. However, depending on the capabilities of the printer 10 the image 14 of the replaceable consumable may be a color image and may include more detail of the actual packaging. Furthermore, the image 14 of the replaceable consumable may include more than one image, such as, an isometric view showing different sides of the replaceable consumable if the additional views aid in the selection of the correct consumable.

Figure 2:
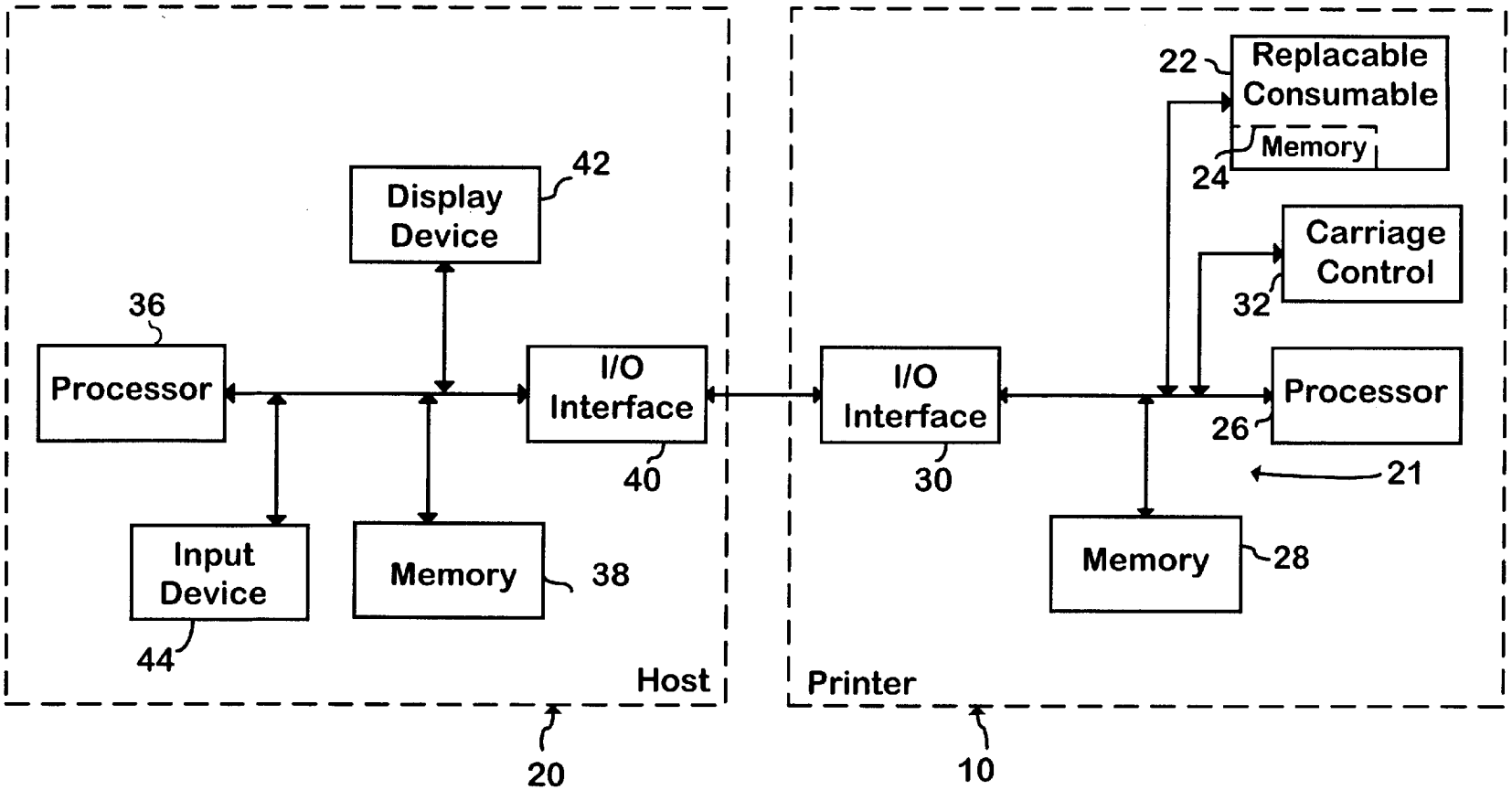
FIG. 2 is a block diagram of a printing system that includes a printer which incorporates a preferred embodiment of the apparatus for selecting printer consumables of the present invention.

FIG. 2 depicts a block diagram of the printing device 10 of the present invention which is linked to a host device 20. The host device 20 is configured for providing image information to the printing device 10 for forming images on print media 12. The printing device 10 of the present invention includes a replaceable consumable 22 and a device 21 for identifying a condition for printing an image 14 of the replaceable consumable 22. If this condition is present the printing device of the present invention 10 prints the image 14 of the replaceable consumable 22 on print media 12 to aid in the selection of the replaceable consumable. FIG. 2 is intended to be a simplified representation for illustrative purposes and is not intended to be a complete diagram of the actual printing device 10 or host device 20.

In the preferred embodiment, the printing device 10 of the present invention includes a replaceable consumable 22 for forming images on print media 12 and a memory element 24 associated with the replaceable consumable 22. The replaceable consumable 22 in the case of ink jet printing is an ink cartridge or an off-axis ink supply. In the case of electrophotographic printing the replaceable consumable 22 is a toner cartridge. The memory element 24 is a memory device that is associated with the replaceable consumable 22 contains image information for the replaceable consumable 22. The memory element 24 is a non-volatile memory such as semiconductor memory such as read only memory (ROM), some form of programmable memory such as EPROM or a conventional non-volatile form of memory.

The printing device 10 includes a device 21 for identifying a condition for printing an image 14 of the replaceable consumable 22 which includes a processor 26 and a memory 28. The processor 26 is part of a microprocessor, programmable controller or custom hardware for identifying a condition for printing the replaceable consumable 22. In the preferred embodiment of the device 21, the processor 26 executes programs and or instructions which are stored in memory 28 for identifying a condition for printing the replaceable consumable 22. These conditions may include a condition where the replaceable consumable 22 is exhausted or no longer is capable of reliably producing output images having the proper quality. Other conditions where an image of the replaceable consumable 22 may be printed is if an image 14 of the replaceable consumable 22 is requested by the user. In this case the user requests the printing of the image 14 on print media 12 to use as a shopping list to stock up on the replaceable consumable 22. In addition, the replaceable consumable image 22 may be requested by the host 20. In this case instructions are provided by the host 20 to print the image 14 of the replaceable consumable 22. An example when the host 20 may request such an image is if the printer 10 is not capable of properly forming a particular image with the present consumable 22. In this case the image 14 of the consumable that is printed is the consumable that is needed to properly form the particular image requested.

The printing device 10 also includes an input/output interface 30 and carriage control 32. The processor 26 executes programs stored in memory 28 for controlling printer functions such as the I/O interface 30, carriage control 32 and monitoring the replaceable consumable 22. The memory 28 in the preferred embodiment includes nonvolatile memory such as ROM and a data memory such as semiconductor Read Access Memory (RAM). The processor 26 executes programs out of memory 28 for controlling the printer 10. Image data is received by the host device 20 from the I/O interface 30 and is either stored in memory 28 or is provided directly to the carriage control 32 for forming an image on print media 12.

The host device 20 includes a processor 36, memory 38, I/O interface 40, display device 42, and input device 44. The host device 20 represents a device for executing application programs out of memory 38 for creating image information. The host device 20 typically includes an input device 44 such as a keyboard, mouse or some other conventional form of input device. The display device. 42 provides a means for displaying information such as information relating to applications programs, operation of the host device 20, and operation of the printing device 10.

The memory 38 typically includes a non-volatile memory such as ROM which is dedicated to program memory and some form of semiconductor memory such as RAM for data storage. In addition, the memory 38 may include a mass storage memory such as a rotating magnetic storage memory or optical storage memory.

The I/O interface 40 provides image information to the printer 10 in a predetermined manner. The I/O interface 40 is controlled by the processor 36 which operates under program control of programs stored in memory 38. This interface program is sometimes referred to as a device driver which is stored in memory 38. The device driver controls the transfer of image information to the I/O interface 30 such that this image information is properly transferred to the printer 10. In general, the device driver for the particular printer 10 must be preloaded into the host 20 before image information provided by the host 20 can be used by the printer 10 to form images.

The device driver software controls the transfer of information between the host device 20 and the printer 10. In addition, the device driver software converts image descriptions created by application programs to binary image information which is then used by the printer 10 to create images on print media 12. Because this binary image is dependent on how the particular printer 10 forms the image, the device driver software or program is usually specific to the particular printer 10.

Figure 3:
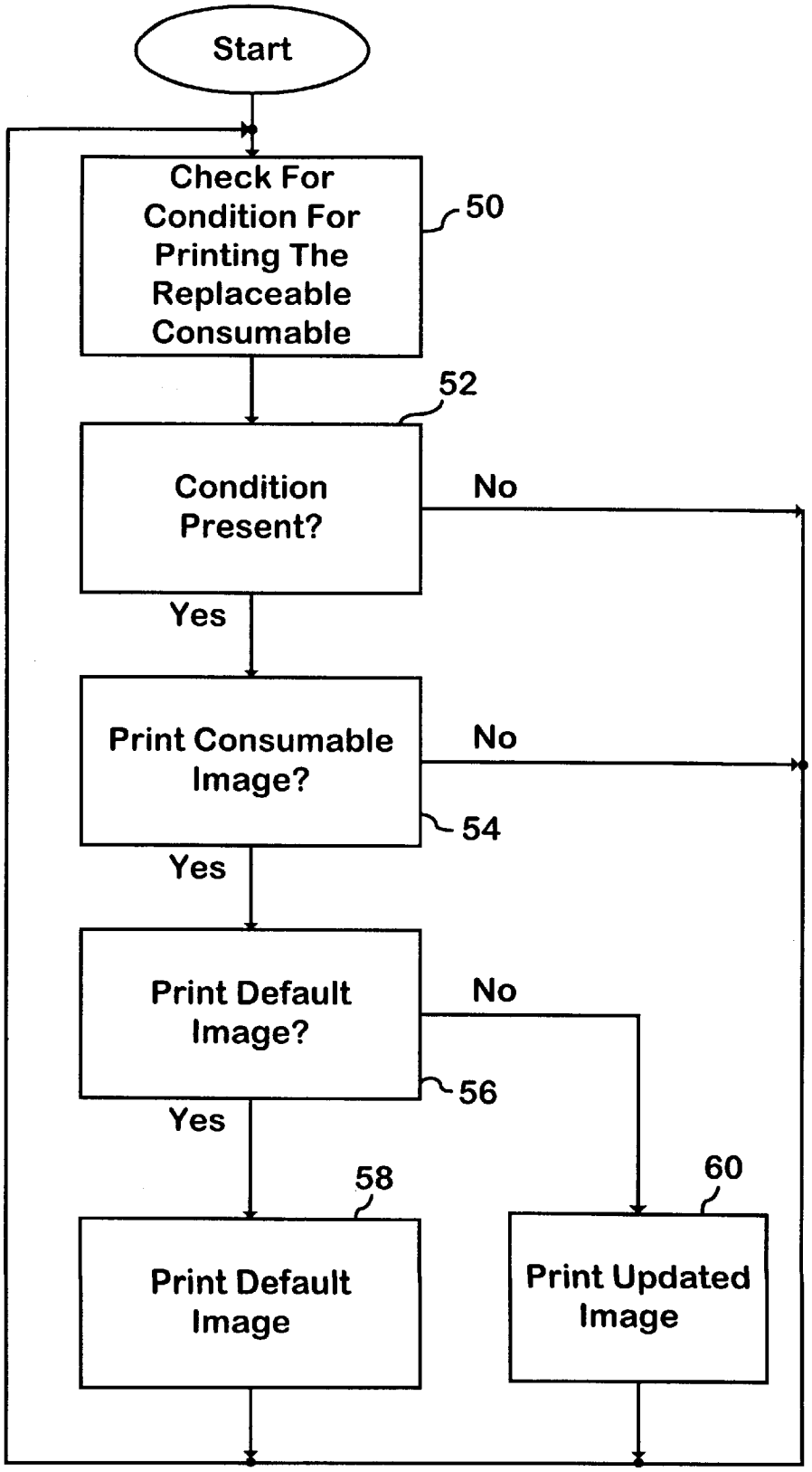
FIG. 3 depicts a preferred embodiment of the method of the present invention for selecting printer consumables.

FIG. 3 depicts the preferred method of the present invention for selecting the replaceable consumable 22. The method begins by checking for a condition for printing an image 14 of the replaceable consumable 22 as represented by step 50. The conditions for printing the image 14 of the replaceable consumable 22 may include that the consumable level is low or empty, the proper consumable 22 is not installed in the printer 10, or that the user has requested a printout of the consumable image, to name a few. The detection of a consumable low condition can be determined by the use of a transducer for sensing a level or amount of remaining consumable. Alternatively, some form of a use monitor such as drop counting, in the case of ink jet printing, can also be used to determine the consumable level. The use of the transducer in combination with the use monitor can also be used to determine the consumable level. It is important that the condition for printing the image 14 of the replaceable consumable 22 be identified before the consumable 22 is empty so that the printer 10 is capable of forming the image 14.

If one of these conditions from step 50 is present as represented by step 52 then the method proceeds to a decision step as represented by step 54. A decision is made in step 54 whether to print the replaceable consumable image 14. This decision step is an optional step which is performed to prevent the printing of more than one image 14 of the replaceable consumable 22 or to prevent the printing of the image 14 if the user does not wish to have a image 14 of the replaceable consumable 22 printed then the image 14 will not be printed. The user can be prompted using the display device 42 on the host 20, a display device 42 associated with the printer 10 (not shown) or the use of a voice synthesizer on the printer 10. This decision step allows the user to override or cancel the printing of the image 14 of the replaceable consumable 22 for a case where the user already has this information thus preventing waste of consumables and print media.

If an image 14 of the replaceable consumable 22 is to be printed a decision is then made whether a default image or an updated image should be printed, as represented by step 56. Step 56 is an optional step which may be used if the packaging for the replaceable consumable changes over the lifetime of the product. If the packaging of the replaceable consumable 22 is changed then the consumable images can be updated to reflect the latest packaging. If the replaceable consumable image 14 that is stored as the default image is the most current or the packaging has not changed then the default image is printed as represented by step 58. However, if the default image is not current, an updated image is printed as represented by step 60.

After an image is printed as represented by steps 58 or 60 or a condition is not present for printing the replaceable consumable represented by step 52 or the replaceable consumable image is not to be printed then the method returns to the step of checking for a condition for replacing the consumable 22 as represented by step 50.

In one preferred embodiment a bit map image of the replaceable consumable 22 packaging is stored in the memory device 24 that is associated with the replaceable consumable 22. In this preferred embodiment, the memory device 24 is attached to the replaceable consumable 22 and becomes electrically connected to the printer 10 when the replaceable consumable 22 is installed into the printer 10. For this case, the image information from the memory 24 is used by the processor 26 to control the carriage 32 for forming the image 14 of the replaceable consumable 22. To minimize to amount of memory required compression can be used to reduce the memory size required.

In an alternative embodiment, the image information of the replaceable consumable 22 is stored in the print driver software stored within memory 38 of the host device 20. This image information includes current package image information. In addition the image information may include separately stored images of important logo's to support blowups or enlargements of these images. The print driver software is installed in the host device 20 during the initial setup of the printer 10 and the host 20. A coding system is then used to compare a static image of the replaceable consumable 22 in the driver with a dynamic image information contained in memory 24 within the replaceable consumable 22 which is installed in the printer 10. This coding system performs the method of step 56 of FIG. 3 which is the determination if the replaceable consumable image information stored in the host device 20 represents the current consumable image information or whether the consumable packaging has been updated thus requiring that an updated image be printed as represented by step 60 in FIG. 3. The coding system is preferably performed by processor 26.

A preferred method for updating the image information of the replaceable consumable 22 to ensure that a current image 14 of the replaceable consumable 22 is printed is to store a series of drawing commands in the memory 24 associated with the replaceable consumable 22. These drawing commands are then executed by the processor 26 to control the printer 10 to form the image 14 of the replaceable consumable 22 on print media 12. By storing command information in the memory 24 instead of bitmap image information the memory requirements of memory 24 can be greatly reduced. These drawing commands are a series of steps or building blocks for forming the image 14 of the replaceable consumable 22. Once each of these drawing commands or primitives are performed by the processor 26, the image 14 of the replaceable consumable 22 is formed.

Another method for updating the image information for forming an image 14 of the replaceable consumable is for this image information to be loaded in the host 20 or the printer 10 directly. The image information can be loaded by connecting to a predesignated storage site such as a server either on the internet containing an updated image or program information that can be loaded into the host 20 or printer 10. The loading of this image information can be done manually or automatically. This updated image information ensures that the image 14 of the replaceable consumable 22 reflects the packaged replaceable consumable 22 presently available at purchasing locations such as retail stores.

The present invention is a printing device 10 that is capable of identifying conditions for printing an image 14 of the replaceable consumable 22 and then printing the image 14 of the consumable 22 on print media 14 so that the user can properly select the proper consumable for the printer 10. By printing the image 14 on print media 12 the user can visually compare consumables on display at a point of purchase display with the image 14 on print media to ensure that the proper consumable is selected. By ensuring the proper consumable is selected the first time the user minimizes the number of trips necessary to replace the consumable as well as ensures that the consumable is compatible with the users particular application. In addition to printing an image 14 the present invention may also print a list of retail outlets where the replaceable consumable 22 may be purchased.

What is claimed is:

1. A printing device of the type having a replaceable consumable for forming images on print media, the printing device comprising:

a control device responsive to input signals for determining a condition for printing a graphical image of the replaceable consumable packaging; and a storage device linked to the control device, the storage device containing graphical image information wherein the printing device forms a graphical image of the replaceable consumable packaging upon an occurrence of the condition for printing an image of the replaceable consumable packaging.

2. The printing device of claim 1 wherein the storage device is located on the replaceable consumable.

3. The printing device of claim 1 further including a host for providing image information to the printing device, the host containing consumable image information wherein the image formed on print media of the replaceable consumable is based on image information provided by the host.

4. The printing device of claim 1 wherein the storage device is a semiconductor storage device.

5. The printing device of claim 1 wherein the printing device is an ink jet based printing device.

6. The printing device of claim 1 wherein the printing device is an electrophotographic based printing device.

7. The printing device of claim 1 wherein the condition for printing the graphical image of the replaceable consumable packaging is based on input signals indicative of an empty condition for the replaceable consumable.

8. A method for selecting consumables for a printing device having a replaceable consumable, the method comprising:

receiving a control signal;

determining a condition for printing a graphical image of a packaged replaceable consumable based on the control signal; and forming the graphical image on print media of the packaged replaceable consumable upon an occurrence of the condition for printing the graphical image.

9. The method for selecting consumables of claim 8 further including identifying the replaceable consumable from a plurality of replaceable consumables by visually matching the packaged replaceable consumable graphical image on print media with packaging associated with the replaceable consumable.

10. The method for selecting consumables of claim 8 further including loading the packaged replaceable consumable graphical image information in one of the a host and the printing device.

11. A printing device for forming images on print media, the printing device capable of receiving image information from a host that is configured for use with the printing device, the printing device having a replaceable consumable comprising:

a receiving device for receiving a signal indicative of a condition for printing a graphical image of the packaged replaceable consumable; and a print control device, linked to the receiving device, for receiving image information for forming the graphical image on print media of the packaged replaceable consumable if the signal indicative of the condition for printing an image of the packaged replaceable consumable is present.

12. The printing device of claim 11 further including a storage device associated with the printing device, the storage device contains a graphical image of the packaged replaceable consumable.

13. The printing device of claim 12 wherein the storage device is located on a host device.

14. The printing device of claim 12 wherein the storage device is located on the printing device.

15. The printing device of claim 11 wherein the signal indicative of the condition for printing the graphical image of the packaged replaceable consumable is generated by the printing device.

16. The printing device of claim 11 wherein the signal indicative of the condition for printing the graphical image of the packaged replaceable consumable is generated by a host device.

17. The printing device of claim 11 wherein the signal indicative of the condition for printing the graphical image of the packaged replaceable consumable is generated by the printing device.

18. The printing device of claim 11 wherein the signal indicative of the condition for printing the graphical image of the packaged replaceable consumable is generated by a host device.

* * * * *

UNITED STATES PATENT AND TRADEMARK OFFICE
CERTIFICATE OF CORRECTION

PATENT NO :6,102,508
DATED : August 15, 2000
INVENTOR(S) :Bruce Cowger

It is certified that error appears in the above-identified patent and that said Letters Patent are hereby corrected as shown below:

Column 8, line 1 of the Patent, delete "in one of the" and insert --in one of a---.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*